United States Patent [19]

Jeschke

[11] 4,395,949

[45] Aug. 2, 1983

[54] SHEET TRANSPORT DRUM ASSEMBLY IN A ROTARY PRINTING PRESS

[75] Inventor: Willi Jeschke, Heidelberg, Fed. Rep. of Germany

[73] Assignee: Heidelberger Druckmaschinen, Heidelberg, Fed. Rep. of Germany

[21] Appl. No.: 366,649

[22] Filed: Apr. 8, 1982

Related U.S. Application Data

[63] Continuation of Ser. No. 138,578, Apr. 8, 1980, abandoned.

[30] Foreign Application Priority Data

Apr. 9, 1979 [DE] Fed. Rep. of Germany ..... 2914362

[51] Int. Cl.[3] ..... B65H 5/06

[52] U.S. Cl. ..... 101/420; 101/416 A; 101/231; 271/276

[58] Field of Search ..... 101/177, 183, 217, 229–231, 101/416 R, 416 A, 416 B, 420; 271/276, 277, 195, 82, 309

[56] References Cited

U.S. PATENT DOCUMENTS

| | | | |
|---|---|---|---|
| 3,334,897 | 8/1967 | Sharkey | 101/231 X |
| 3,341,195 | 9/1967 | Brandt | 271/276 |
| 3,363,520 | 1/1968 | Obenshain | 271/276 X |
| 3,542,358 | 11/1970 | Schuhmann | 101/420 X |
| 3,986,455 | 10/1976 | Jeschke | 271/276 X |

FOREIGN PATENT DOCUMENTS

| | | | |
|---|---|---|---|
| 475090 | 8/1969 | Switzerland | 101/416 A |

*Primary Examiner*—A. J. Heinz

*Attorney, Agent, or Firm*—Herbert L. Lerner; Laurence A. Greenberg

[57] ABSTRACT

Sheet transport drum assembly in a rotary printing press wherein a sheet being transported rests upon an air cushion formed by blowing air between the jacket of a rotatable transport drum and the sheet, including air nozzle means for producing the air cushion, and sealing strips disposed on the drum jacket for limiting the air cushion at a location of the drum jacket underlying the leading edge and the two lateral edges of the sheet.

10 Claims, 10 Drawing Figures

SHEET TRANSPORT DRUM ASSEMBLY IN A ROTARY PRINTING PRESS

This is a continuation, of application Ser. No. 138,578, filed Apr. 8, 1980 and now abandoned.

The invention relates to a sheet transport drum on rotary printing presses wherein the transported sheets rest on an air cushion formed by blowing or compressed air between the drum jacket and the sheet.

When transporting freshly printed sheets on transport drums whereon the yet freshly printed image comes to rest on the drum jacket, there exists the danger that any contact between ink and drum jacket will result in a smearing of the wet ink on the sheet, thereby rendering the printed product useless.

In a heretofore known sheet transport drum of this general type, German Patent (DE-PS) No. 1 561 043, a thin air cushion is produced on the peripheral surface of the drum, and the sheet is supposed to rest on this thin air cushion in order to prevent any smearing of the ink. This heretofore known sheet transport drum is of double-wall construction and has a covering formed of porous, air-permeable material. When blowing or compressed air is blown between the double walls into the cavity, it escapes through the air-permeable covering and forms the air cushion under the transported sheet.

The heretofore known sheet transport drum has a disadvantage in that it is costly to manufacture and requires large quantities of blowing or compressed air in order to produce the air cushion. In addition to the costs of setting up, this sheet transport drum has a high energy requirement and has an unfavorable effect upon the room air condition or climate in the printing shop. With the large quantity of air required, there is also an undesired supply of heat to the medium, resulting in distortion or delay of the paper. It is therefore necessary to provide additional cooling and moistening equipment for the blowing or compressed air, resulting in a further cost increase.

It has also been shown that, with a thin air cushion, there is the danger that, when working with stiff cardboard, there is some local contact between the sheet transport drum and the printed surface of the cardboard. If, however, the surface of the porous covering becomes smeared with ink, it is essential that the covering be removed and the parts be washed with a solvent. In addition to the downtime of the press, this also results in costs which cause an increase in the price of the printed products.

It is accordingly an object of the invention to provide a sheet transport drum assembly with an air cushion for the transported sheets, which is simple and relatively inexpensive to manufacture, has a low compressed air consumption, and is able to handle all paper thicknesses up to cardboard without smearing as well as being easy to clean and maintain.

With the foregoing and other objects in view, there is provided, in accordance with the invention, a sheet transport drum assembly in a rotary printing press wherein a sheet being transported rests upon an air cushion formed by blowing air between the jacket of a rotatable transported drum and the sheet, comprises air nozzle means for producing the air cushion, and sealing strips disposed on the drum jacket for limiting the air cushion at a location of the drum jacket underlying the leading edge and the two lateral edges of the sheet. The limiting of the air cushion at the front edge and at the two lateral edges of the sheet creates an accumulated air space under the sheet wherein the air nozzles produce dynamic pressure by which the printed sheet is carried. This construction permits the simple formation of an air cushion which allows a greater distance between the sheet and the drum jacket, thereby safely preventing any smearing of the sheets on the drum jacket. The air consumption is clearly lower than in a construction without an accumulated air space.

In accordance with another feature of the invention, the air nozzle means are disposed so as to direct an air flow initially against the sealing edge at the location of the drum jacket underlying the leading edge of the sheet so as to effect a build-up of air thereat before the air cushion forms between the sheet and the drum jacket with continued rotation of the sheet transport drum.

In accordance with a further feature of the invention the air nozzle means comprise air nozzles disposed outside the sheet transport drum ahead of a sheet transfer point at which the sheet is transferred to the sheet transport drum, the air nozzles being disposed so as to blow air in direction of rotation of the sheet transport drum between the sheet and the drum jacket. It is not necessary to introduce air into the rotating drum per se. A particular feature of this embodiment of the invention is its simple construction and ease of maintenance.

In accordance with an added feature of the invention, the air nozzle means comprise air nozzles disposed on the drum jacket and directed so as to blow air against the sealing strip at the location of the drum jacket underlying the leading edge of the sheet and between the sheet and the drum jacket, the air nozzles being disposed on part of the length of the drum jacket starting at a beginning end of the sheet, and means for sequentially supplying the air nozzles with blowing air, respectively in vicinity of a center line at a sheet transfer point at which the sheet is transferred to the sheet transport drum, in accordance with progressive rotation of the transport drum. Using this considerably simplified method of introducing air into the rotating drum, it is likewise possible, employing simple means, to form an air cushion under the transported sheet. This construction also has a minimum possible consumption of blowing or compressed air.

In accordance with an additional feature of the invention, the drum jacket is air-tight, and the sealing strips disposed at the location of the drum jacket underlying the two lateral edges of the sheet comprise sealing rings movable in axial direction of the sheet transport drum, the drum jacket having an outer diameter less than the outer diameter of the sealing rings by the amount of thickness of the latter, the sealing strip disposed at the location of the drum underlying the leading edge of the sheet extending over the axial length of the drum jackets, the air nozzle means being mounted outside the sheet transport drum on a blowpipe extending over the axial length of the drum jacket. Any desired drum of a printing press can be constructed in this manner in order to prevent damage to the freshly printed side of the sheet facing the drum.

In accordance with yet another feature of the invention, the sealing rings and the sealing strip at the location of the drum underlying the leading edge of the sheet are disposed so as to support the sheet being transported. This feature ensures faultless operation even when working with cardboard, because the sheets are also mechanically supported by the lateral rings.

In accordance with yet a further feature of the invention, the sealing strips disposed at the location of the drum jacket underlying the two lateral edges of the sheet comprise sealing rings, the sheet and the sealing strip at the location of the drum underlying the leading edge of the sheet and the sealing strips at the sides of the sheet sealing the air cushion therebetween.

In accordance with yet an added feature of the invention, the sheet transport drum assembly includes means for cyclically turning on the blowing air upon take-over of the sheet by the sheet transport drum from an impression cylinder located ahead of the sheet transport drum and defining a printing gap therebetween, and means for turning off the blowing air when the sheet leaves the printing gap.

In accordance with yet an additional feature of the invention, the sheet transport drum assembly includes means for controlling the time interval for turning-on and turning-off the blowing air comprising a pair of mutually adjacent discs formed with air openings, the discs being adjustably mounted on a journal secured to the shaft of the sheet transfer drum.

In accordance with a concomitant feature of the invention, the sheet transport drum assembly includes means comprising a valve for turning the blast air on and off; contactless switches disposed for controlling the valve, a control segment adjustable for varying the time interval for turning on and turning-off the blowing air, the control segment being rotatable at the same speed as that of the sheet transport drum.

The constructional features of the described embodiment make it possible both to handle thin grades of paper, in which case it is not absolutely essential to have the mechanical support of the lateral rings, as well as thick sheets, irrespective of the size thereof, without any contact between the sheet surface and the drum jacket, with the result that any damage to the printed image is reliably prevented.

Other features which are considered as characteristic for the invention are set forth in the appended claims.

Although the invention is illustrated and described herein as embodied in a sheet transport drum assembly in a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
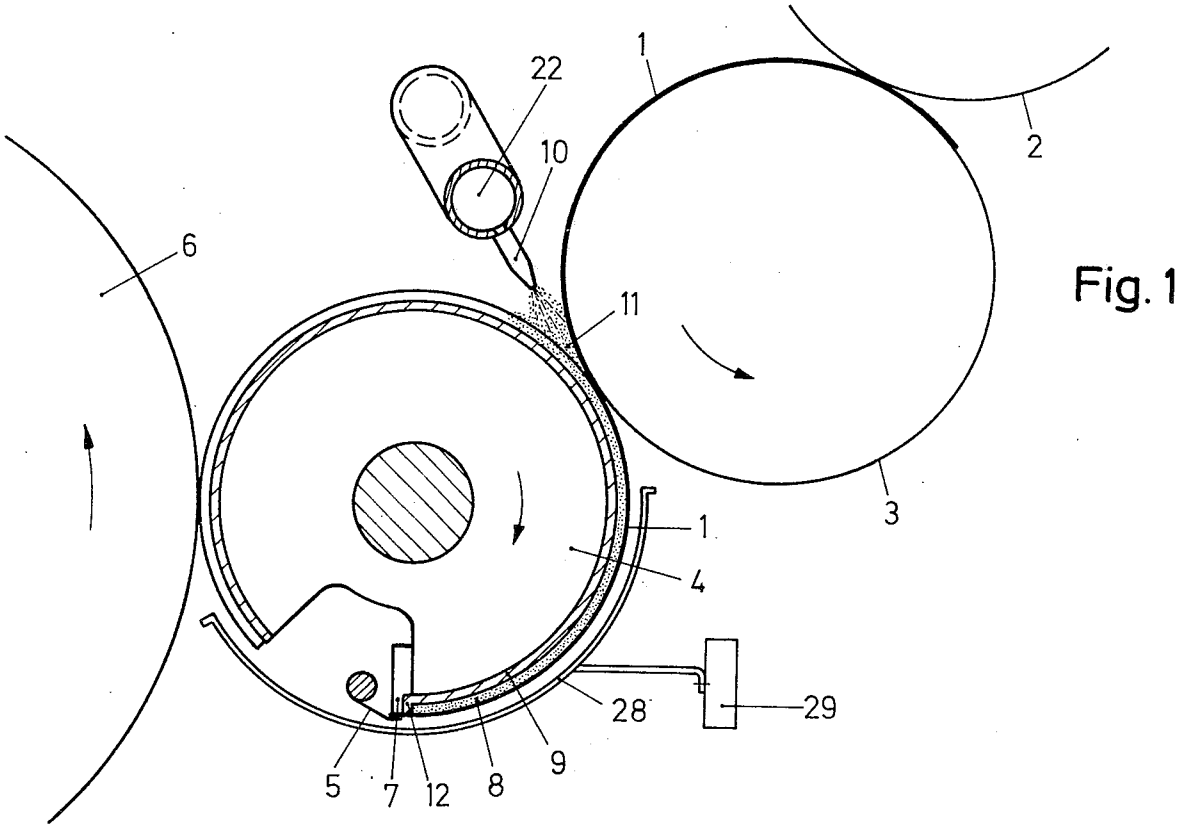
FIG. 1 is a side elevational view of a sheet transport drum with air nozzles located outside the sheet transport drum, constructed in accordance with the invention.

Referring now to the drawing and first, particularly, to FIG. 1 thereof, there is shown an embodiment of a sheet transport drum of a sheet-fed offset printing press with conventional cylinder arrangement. The sheet 1 is printed between a rubber covered or blanket cylinder 2 and an impression cylinder 3 and is fed by nonillustrated grippers of the impression cylinder 3 to a sheet transport drum 4 having grippers 5 which take over the sheet in the nip between the impression cylinder 3 and the sheet transfer drum 4. Thereafter, the sheet 1 is transferred from the sheet transport drum 4 to nonillustrated grippers of a transfer drum 6.

The sheet 1 held on the sheet transport drum 4 between the gripper 5 and a gripper support bar 7 rests on an air cushion 8 which is generated by means of compressed air between the drum jacket 9 and the sheet 1. The air cushion 8 is generated by air nozzles 10 which are provided ahead of the nip at the sheet transfer point between the impression cylinder 3 and the sheet transport drum 4. The air current 11 of the air nozzles 10 is directed initially against the sealing strip 12 provided under the front edge of the sheet 1. This results in a buildup of air from which, as the sheet transport drum 4 rotates further, the air cushion 8 is formed between the sheet 1 and the drum jacket 9.

Figure 2:
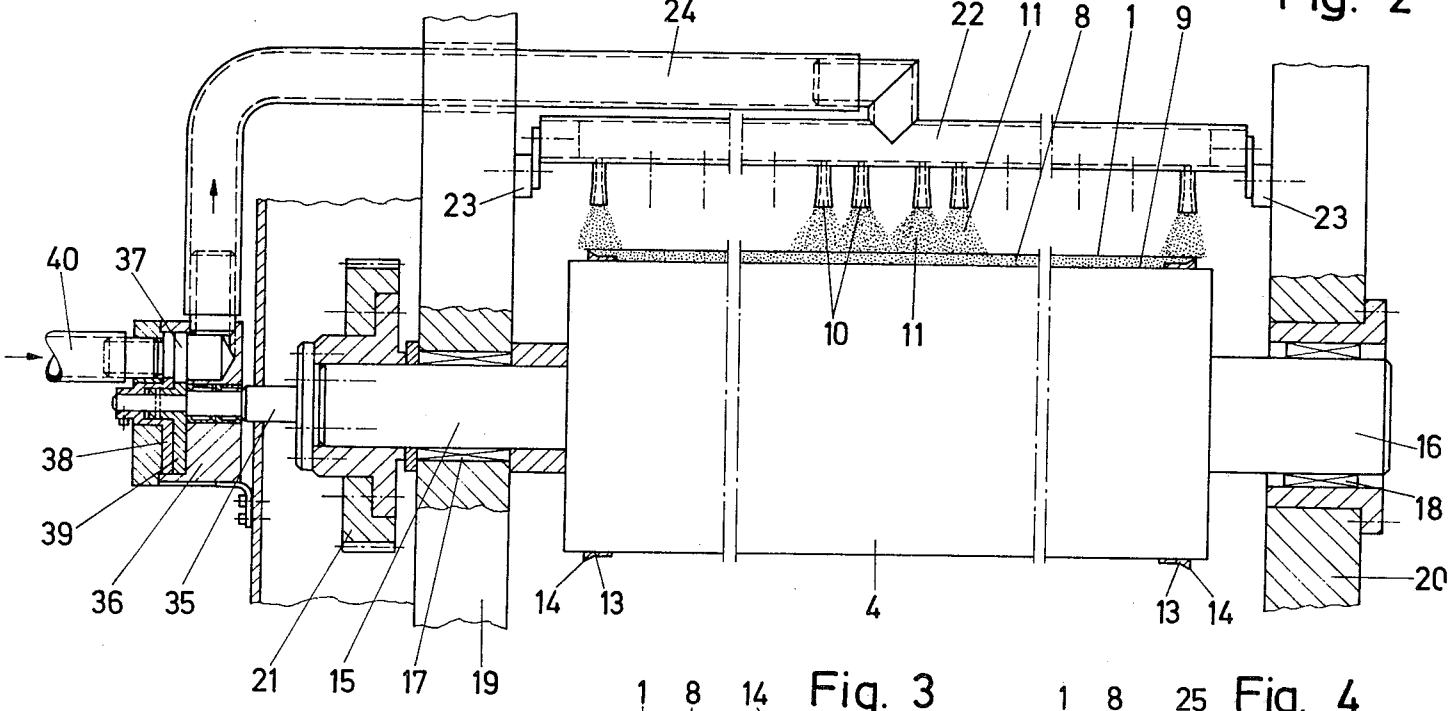
FIG. 2 is an axial view partly in section of the sheet transport drum with air nozzles located outside the sheet transport drum shown in FIG. 1.

The air nozzles 10, which are located outside the sheet transport drum 4 ahead of the sheet transfer point in the center line at the nip between the transport drum 4 and the impression cylinder 3, blow air in the direction of rotation of the sheet transport drum 4 between the sheet 1 and the drum jacket 9. The drum jacket 9 is of air-tight construction and has on each side thereof a sealing ring 13 which is movable in axial direction of the sheet transport drum 4 (FIG. 2). The radius of the drum jacket 9 is constructed smaller by the thickness of the sealing rings 13, with the result that the diameter of the support edge 14 for the sheet 1 corresponds exactly to the theoretical drum diameter.

As can be seen in FIG. 2, shaft journals 15 and 16 on both sides of the sheet transport drum 4 are mounted in bearings 17 and 18 in side frames 19 and 20 of the press. The shaft journal 15 has a spur gear 21 for driving the sheet transport drum 4.

Between the side frames 19 and 20 and extending over the length of the drum jacket 9, there is a blowpipe 22 which is mounted on the side frames 19 and 20 by means of holders 23. Mounted, in turn, on the blowpipe 22 are the air nozzles 10 which generate a fan-like air current over the length of the sheet. The compressed air is supplied to the blowpipe 22 through a hose 24.

Figure 4:
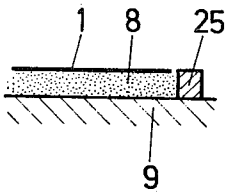
FIG. 4 is a view similar to that of FIG. 3 of another embodiment of a lateral sealing ring with sealing at the end face of the sheet.
Figure 3:
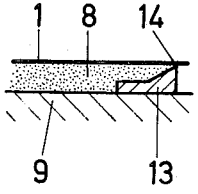
FIG. 3 is an enlarged fragmentary view of FIG. 2 showing a section of a lateral sealing ring thereof with a sheet resting in place.

FIG. 3 is an enlarged sectional view of a lateral sealing ring 13, the sheet 1 resting on the support edge 14 thereof. This is particularly advantageous when the sheet material is thick. In a modified construction shown in FIG. 4, a sealing ring 25 is provided by which the air cushion 8 is sealed at the end face of the sheet 1. In this case, too, the air cushion is sealed in the forward or leading region of the transported sheet 1 on the sealing strip 12. This construction may, for example, be used with very thin sheet material.

Figure 5:
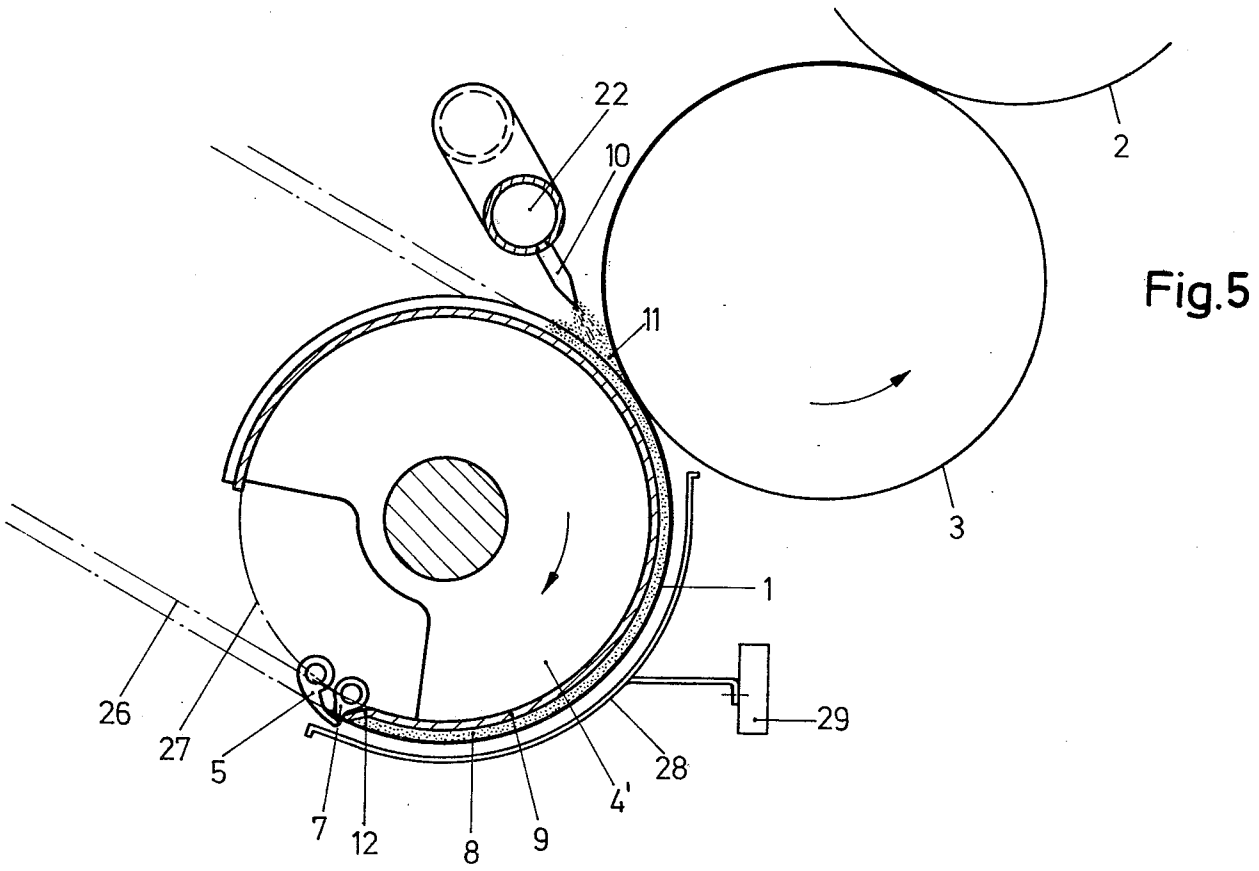
FIG. 5 is a view similar to that of FIG. 1 of a further embodiment of the invention showing the sheet transport drum at the chain delivery with air nozzles located outside the sheet transport drum.

The embodiment shown in FIG. 5 includes a sheet transport drum 4' at the end of the printing press from which the sheets are conducted via a chain system 26 to the delivery. For this purpose, the sheet transport drum 4 has, on both sides of the drum jacket 9 thereof, a sprocket wheel 27 over which the chains 26 are routed. In this construction, the grippers 5 and the gripper support bar 7 are fastened to the chains 26. The mode of operation of the blowing compressed air does not differ from that of the previously described embodiment. Additionally, with the construction shown, it is possible to assign a sheet guide plate 28 to the sheet transport to a cross-beam 29 and prevents the end of the sheet from falling downwards in an uncontrolled manner.

Figure 6:
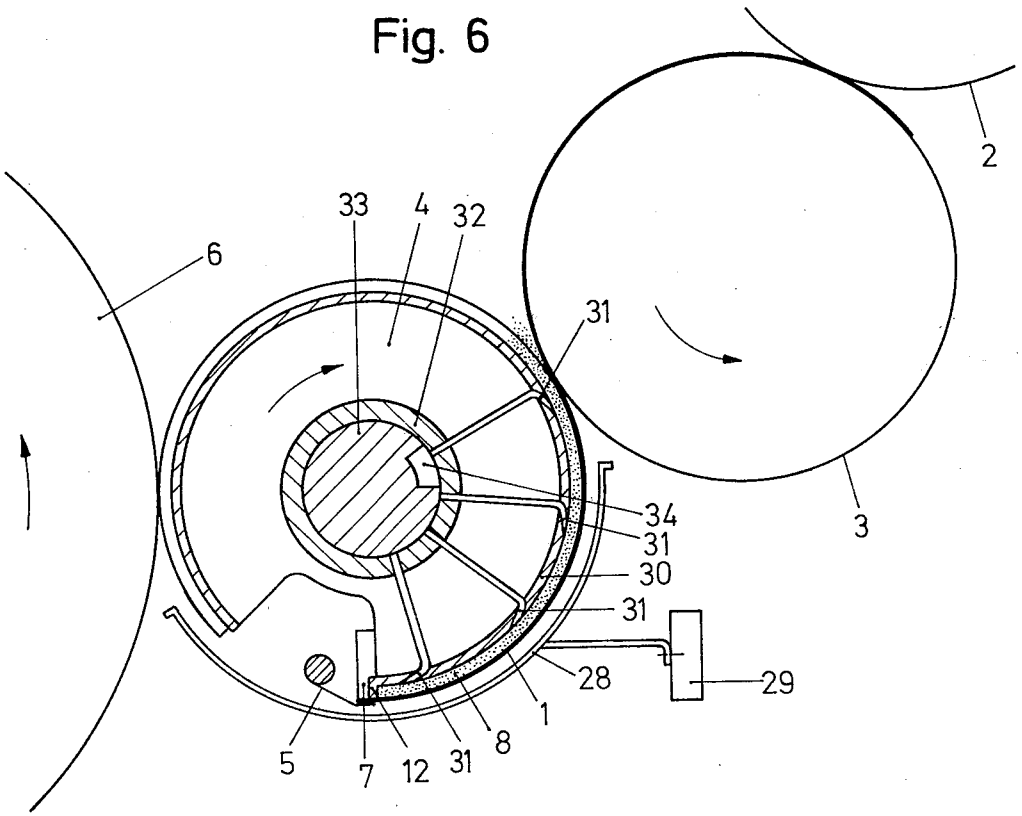
FIG. 6 is a view similar to that of FIG. 1 of an additional embodiment of the invention showing a sheet transport drum with air nozzles located inside the sheet transfer drum.

The embodiment of the invention shown in FIG. 6 differs from those previously described herein in that, provided on the drum jacket 30, are air nozzles 31 which are directed against the sealing strip 12 provided at the front edge of the sheet 1 and are located on a partial length of the drum jacket 30, starting at the beginning of the sheet. In the embodiment shown in FIG. 6, there are four rows of air nozzles 31. The air nozzles 31 penetrate the drum body as far as the bore of a hollow shaft 32 which rotates on a shaft 33 with the sheet transport drum 4. The shaft 33 is provided with a longitudinal chamber 34 through which the compressed air is fed to the nozzles 31. In accordance with the progressive rotation of the drum, the air nozzles 31 located in the region of the center line to the impression cylinder 3 at the sheet transfer point come into contact consecutively with the longitudinal chamber 34, with the result that they briefly blow air for a period of time between the drum jacket 30 and the sheet 1, thereby forming the air cushion. With this construction, it is merely necessary for the row of air nozzles 31 in the region of the center line to the rubber-covered cylnder 3, viewed in direction of rotation of the drum, to be supplied with compressed air. The air cushion is thereby maintained while there is, simultaneously, minimum consumption of compressed air. The compressed air is supplied axially from outside the side frames, in a conventional manner.

Figure 7:
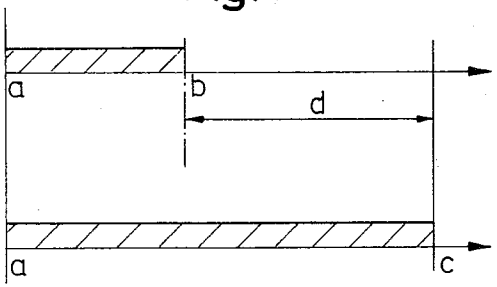
FIG. 7 is a schematic view of a control for the compressed air.

In the case of the embodiments shown, the air cushion is sealed by the transported sheet 1 on the sealing strip 12 and on both sides at the end faces of the sheet by the sealing rings 13, 25 which can be adjusted to the size of the sheet being processed. The compressed air is cyclically switched on as the sheet 1 is transferred and is switched off when the end of the sheet leaves the printing gap of the impression cylinder 3 located ahead of the sheet transport drum 4, 4'. FIG. 7 shows the length of the air supply in the hatched areas. The compressed air is switched on at a. Depending upon the length of the sheet 1 being handled, the air supply is switched off at b in the upper example or at c in the lower example. The adjustment range for switching off the compressed air is represented by d, and depends upon the size of the sheet. Both at b as well as at c, the end of the sheet is just leaving the printing gap or nip between the rubber-covered cylinder 2 and the impression cylinder 3.

The time interval during which the compressed air is on can be regulated mechanically, as shown, for example, in FIG. 2. In this case, mounted on the shaft journal 15 is a pin or journal 35 on which a rotary valve 36 is mounted. The compressed air is controlled by two discs 38 and 39 provided with air openings 37 and mounted on the journal 35. The air openings 37 are set for the maximum blowing time of the compressed air. By turning the disc 38 with respect to the disc 39 which is rigidly mounted on the journal 35, it is possible to shorten the time interval of the air supply. Since both discs 38 and 39 rotate at the speed of the drum 4, it is possible to cycle the compressed air supplied in the hose 40 for specific time intervals, with the result that compressed air is supplied via the hose 24 to the nozzles 10 for the period of the take-over of the sheets 1 by the grippers 5 up to that instant in time at which the end of the sheet leaves the printing gap or nip between the rubber-covered cylinder 2 and the impression cylinder 3.

Figure 8:
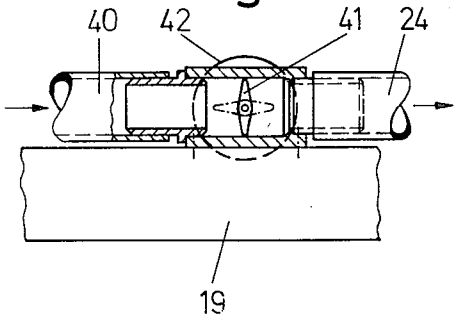
FIG. 8 is an enlarged fragmentary view, partly in section, of a control valve for the compressed air.

FIG. 8 shows a different embodiment of a control valve in which the compressed air is likewise supplied via the hose 40, the blowing time thereof being controllable by means of the valve 41 which can be turned, for example, by a servomotor 42. The hose 24 supplied the compressed air to the nozzles 10 for the length of the set or adjusted blowing time.

Figure 9:
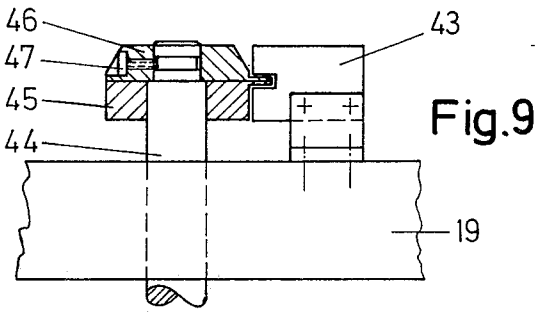
FIG. 9 is a side elevational view, partly in section, of a non-contacting switch for control of the compressed air.

FIG. 9 shows a contactless switch 43 which is mounted on the side frame 19. Two control segments 45 and 46 are mounted on a journal pin 44 which rotates at the speed of the sheet transport drum 4. The control segment 45 is rigidly disposed on the journal 44, whereas the control segment 46 can be adjusted with respect to the control segment 45 by means of the adjusting screw 47.

Figure 10:
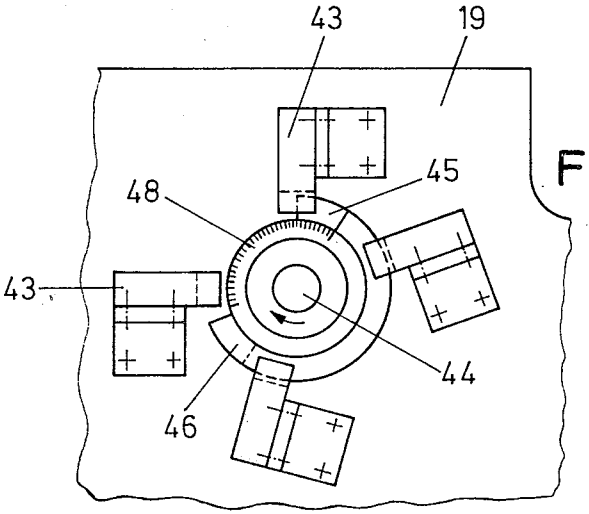
FIG. 10 is a top plan view of FIG. 9 showing an adjustment possibility for switching the compressed air on and off.

FIG. 10 is a top plan view of the control arrangement represented in FIG. 9 wherein the two control segments 45 and 46 have been turned relative to one another, with the result that the blowing time has been shortened by an amount which is settable or adjustable on the scale 48. The valve 41 can be controlled by the servomotor 42 through the contactless switch 43. As can be seen in FIG. 10, several switches 43 can be associated with the control segments, each switch actuating the valve 41 for controlling the compressed air supply to a sheet transport drum. In the embodiment shown in FIG. 10, there are four switches for four sheet transport drums in a printing press. The offset arrangement of the switches is due to the fact that the sheet transfer to the four drums is not effected simultaneously.

There are claimed:

1. Sheet transport drum assembly including an air blowing device comprised of air nozzles and a rotatable transport drum having a jacket with an outer cylindrical surface in a rotary printing press wherein a sheet having a leading edge and two lateral edges and being transported by the transport drum rests upon an air cushion formed between the outer surface of the jacket of the rotatable transport drum and the sheet, said air cushion being generated by said air blowing device supplying pressurized air to a cavity bounded on opposite sides by the sheet and cylindrical surface and by sealing strips disposed on the outer cylindrical surface of the drum jacket at respective locations of the drum jacket surface underlying the leading edge and the two lateral edges of the sheet, said sealing strips extending radially away from the drum jacket surface for limiting the air cushion whereby the volume of pressurized air required to maintain said air cushion is minimized.

2. Sheet transport drum assembly according to claim 1 wherein said air nozzles define an air flow path substantially tangential to the rotary direction of the transport drum along which an air flow is directable initially against the sealing strip at the location of the drum jacket underlying the leading edge of the sheet for effecting a build-up of air thereat prior to formation of the air cushion between the sheet and the drum jacket with continued rotation of the sheet transport drum.

3. Sheet transport drum assembly according to claim 1 wherein said air nozzles are disposed at locations spaced from the sheet transport drum downstream, in sheet travel direction from a sheet transfer point at which the sheet is transferred to the sheet transport drum, said air nozzles being disposed in a direction of rotation of the sheet transport drum for blowing air in said direction between the sheet and the drum jacket.

4. Sheet transport drum assembly according to claim 1 wherein said air nozzles are disposed on said drum jacket and directed towards the sealing strip at the location of the drum jacket underlying the leading edge of the sheet for blowing air thereagainst and between the sheet and the drum jacket, the drum jacket being of given length and said air nozzles being disposed on part of the given length of the drum jacket starting at a beginning end of the sheet, and means for sequentially supplying said air nozzles with blowing air, respectively in vicinity of a center line at a sheet transfer point at which the sheet is transferred to the sheet transport drum, in accordance with progressive rotation of the transport drum.

5. Sheet transport drum assembly according to claim 1 wherein said drum jacket is air-tight, and said sealing strips disposed at the location of the drum jacket underlying the two lateral edges of the sheet comprise sealing rings movable in axial direction of the sheet transport drum and having a given outer diameter, said drum jacket having an outer diameter less than the given outer diameter of said sealing rings by the amount of thickness of the latter, said sealing strip disposed at the location of the drum underlying the leading edge of the sheet extending over the axial length of the drum jacket, said air nozzles being mounted at locations spaced from the sheet transport drum on a blowpipe extending over the axial length of the drum jacket.

6. Sheet transport drum assembly according to claim 5 wherein said sealing rings and said sealing strip at the location of the drum underlying the leading edge of the sheet having respective surfaces for supporting the sheet being transported.

7. Sheet transport drum assembly according to claim 1 wherein said sealing strips disposed at the location of the drum jacket underlying the two lateral edges of the sheet comprise sealing rings, the sheet and said sealing strip at the location of the drum underlying the leading edge of the sheet and said sealing strips at the sides of the sheet sealing the air cushion therebetween.

8. Sheet transport drum assembly according to claim 1 including means for cyclically turning on the blowing air upon takeover of the sheet by the sheet transport drum from an impression cylinder located downstream, in sheet travel direction, from the sheet transport drum and defining a printing gap therebetween and means for turning off the blowing air when the sheet leaves said printing gap.

9. Sheet transport drum assembly according to claim 1 wherein the blowing air is turnable on and off for a given time interval, and including means for controlling the given time interval for turning-on and turning-off the blowing air comprising a pair of mutually adjacent discs formed with air openings, said discs being adjustably mounted on a journal secured to the shaft of the sheet transfer drum.

10. Sheet transport drum assembly according to claim 1 including means comprising a valve for turning the blowing air on and off for a given time interval, contactless switches disposed for controlling said valve, a control segment adjustable for varying the given time interval for turning on and turning-off the blowing air, said control segment being rotatable at the same speed as that of the sheet transport drum.

* * * * *